US010704435B2

(12) United States Patent
Nakamura et al.

(10) Patent No.: US 10,704,435 B2
(45) Date of Patent: Jul. 7, 2020

(54) BREATHER DEVICE FOR ENGINE

(71) Applicant: KUBOTA Corporation, Osaka-shi, Osaka (JP)

(72) Inventors: Gen Nakamura, Sakai (JP); Koji Okada, Sakai (JP); Tamotsu Kuno, Sakai (JP); Akihiko Kai, Sakai (JP)

(73) Assignee: KUBOTA Corporation, Osaka-Shi, Osaka (JP)

( * ) Notice: Subject to any disclaimer, the term of this patent is extended or adjusted under 35 U.S.C. 154(b) by 98 days.

(21) Appl. No.: 15/988,003

(22) Filed: May 24, 2018

(65) Prior Publication Data

US 2019/0003355 A1 Jan. 3, 2019

(30) Foreign Application Priority Data

Jun. 29, 2017 (JP) ..... 2017-127949

(51) Int. Cl.
*F01M 13/00* (2006.01)
*F02M 35/10* (2006.01)
(Continued)

(52) U.S. Cl.
CPC .... *F01M 13/0011* (2013.01); *F01M 13/0416* (2013.01); *F02M 35/104* (2013.01);
(Continued)

(58) Field of Classification Search
CPC ..... F01M 13/0011; F01M 13/0416; F01M 13/00; F01M 13/04; F02M 35/10288; F02M 35/104; F02M 35/1022; F02M 35/10222
See application file for complete search history.

(56) References Cited

U.S. PATENT DOCUMENTS 9,702,280 B2 * 7/2017 Kira ..... F02F 7/006
10,247,153 B2 * 4/2019 Mueller ..... F01M 13/00
(Continued)

FOREIGN PATENT DOCUMENTS

DE 102009017658 A1 11/2009
EP 1213451 A1 6/2002
(Continued)

OTHER PUBLICATIONS

Extended European Search Report dated Nov. 16, 2018 in EP Application No. 18171320.7.

*Primary Examiner* — Syed O Hasan
(74) *Attorney, Agent, or Firm* — Panitch Schwarze Belisario & Nadel LLP

(57) ABSTRACT

A breather device for an engine which prevents a blow-by gas outlet passage from being blocked due to freezing, is provided, which includes a valve holder in a cylinder head cover and a breather valve supported by the holder. The holder includes a holder body having a valve port of the breather valve, a metal outlet passage pipe having a blow-by gas outlet passage formed inside, the blow-by gas outlet passage communicating with the valve port and being located below the valve port, and a heater that heats the outlet passage pipe. An outer peripheral surface of the outlet passage pipe is wrapped with the holder body formed of a material having lower thermal conductivity than that of the outlet passage pipe. The holder body has a heater insertion port, and the heater is inserted from the heater insertion port toward a heat input wall of the outlet passage pipe.

23 Claims, 3 Drawing Sheets

(51) Int. Cl.
*F01M 13/04* (2006.01)
*F02M 35/104* (2006.01)

(52) U.S. Cl.
CPC ..... *F02M 35/10288* (2013.01); *F01M 2013/0027* (2013.01); *F01M 2013/0038* (2013.01)

(56) References Cited

U.S. PATENT DOCUMENTS

| | | | | |
|---|---|---|---|---|
| 2006/0144376 | A1 | 7/2006 | Gschwind et al. | |
| 2007/0186913 | A1* | 8/2007 | Ideguchi ..... | F01M 13/04 123/574 |
| 2008/0099000 | A1 | 5/2008 | Suzuki et al. | |

FOREIGN PATENT DOCUMENTS

| | | | |
|---|---|---|---|
| EP | 1433994 | A1 | 6/2004 |
| EP | 2982837 | A2 | 2/2016 |
| FR | 2851315 | A1 | 8/2004 |
| JP | 2008045492 | A | 2/2008 |
| JP | 2016056763 | A | 4/2016 |

* cited by examiner

BREATHER DEVICE FOR ENGINE

CROSS-REFERENCE TO RELATED APPLICATION

This application claims priority under 35 U.S.C. § 119(b) to Japanese Patent Application No. 2017-127949, filed Jun. 29, 2017, the disclosure of which is incorporated by reference herein in its entirety.

BACKGROUND OF THE INVENTION

(1) Field of the Invention

The present invention relates to a breather device for an engine.

(2) Description of Related Art

With a conventional breather device for an engine, moisture accumulated in a blow-by gas outlet passage below a valve port of the valve holder of the breather valve is frozen during cold weather, and the blow-by gas outlet passage may be blocked due to freezing.

SUMMARY OF THE INVENTION

An object of the present invention is to provide a breather device for an engine which can prevent a blow-by gas outlet passage from being blocked due to freezing.

In the present invention, a valve holder includes: a holder body having a valve port of the breather valve; an outlet passage pipe formed of metal and having a blow-by gas outlet passage formed inside, the blow-by gas outlet passage communicating with the valve port and being located below the valve port; and a heater that heats the outlet passage pipe. An outer peripheral surface of the outlet passage pipe is wrapped with the holder body formed of a material having lower thermal conductivity than that of the outlet passage pipe, the holder body has a heater insertion port, and the heater is inserted from the heater insertion port toward a heat input wall of the outlet passage pipe.

It is desirable that the outlet passage pipe includes: a pipe start end wall closing a pipe start end; a communication port provided in the pipe upper wall near the pipe start end and communicating with the valve port; and a pipe terminal peripheral wall having a pipe outlet opened at the opposite end of the pipe start end wall, and the pipe start end wall is the heat input wall of the outlet passage pipe.

In the present invention, it is possible to prevent the inside of the blow-by gas outlet passage of the valve holder from being blocked due to freezing.

BRIEF DESCRIPTION OF THE DRAWINGS

FIG. 2A is a longitudinal sectional side view, FIG. 2B is a view seen in a direction of an arrow B in FIG. 2A, FIG. 2C is a sectional view taken along a line C-C of FIG. 2A, and FIG. 2D is a sectional view taken along a line D-D of FIG. 2A.

DETAILED DESCRIPTION OF PREFERRED EMBODIMENTS

Figure 1:
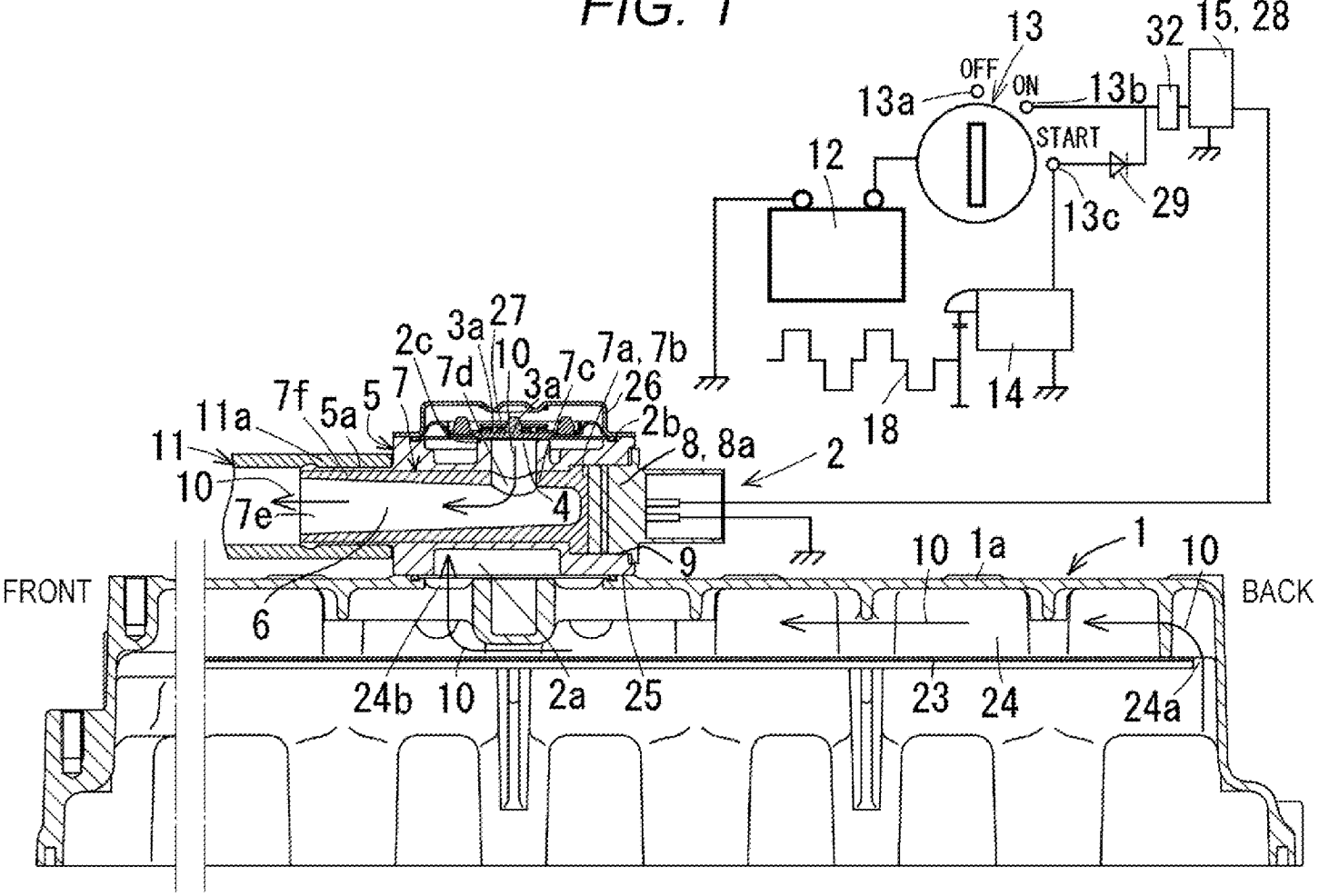
FIG. 1 is a longitudinal sectional side view of a main part for explaining a breather device for an engine according to an embodiment of the present invention.
Figure 2B:
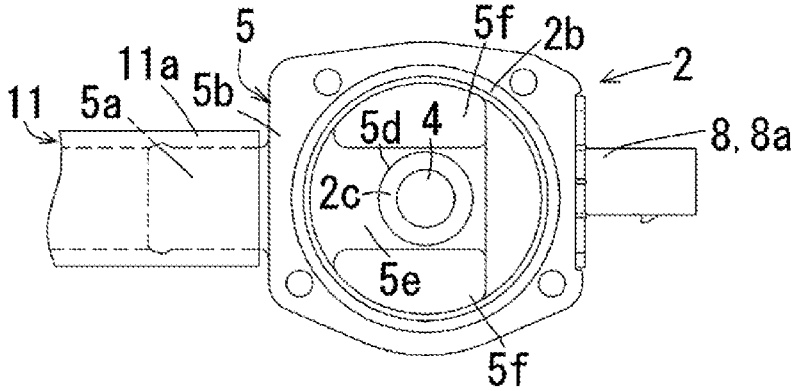
FIGS. 2A to 2D are views for explaining a valve holder used in the breather device of FIG. 1.
Figure 2A:
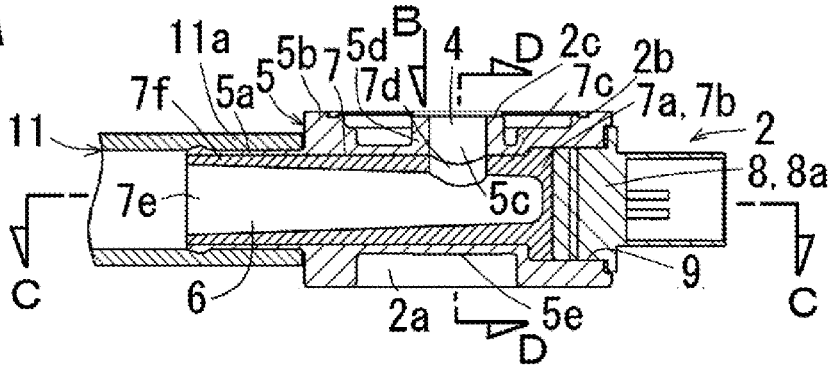
Figure 2C:
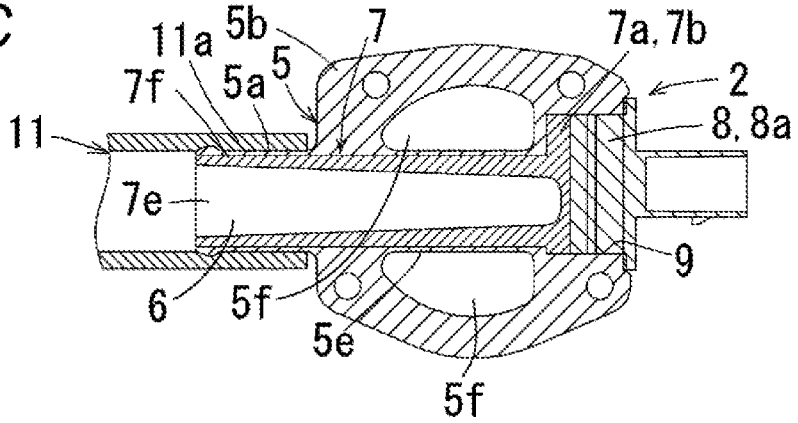
Figure 2D:
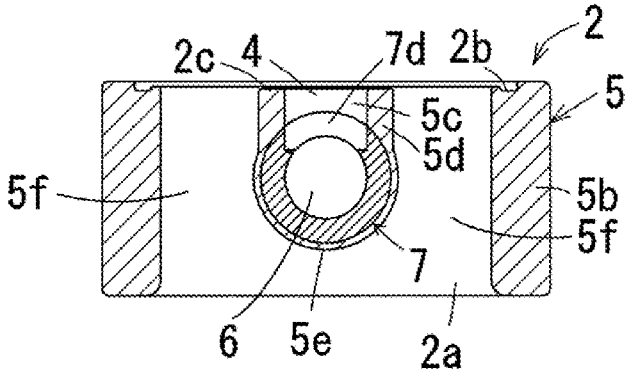
Figure 3:
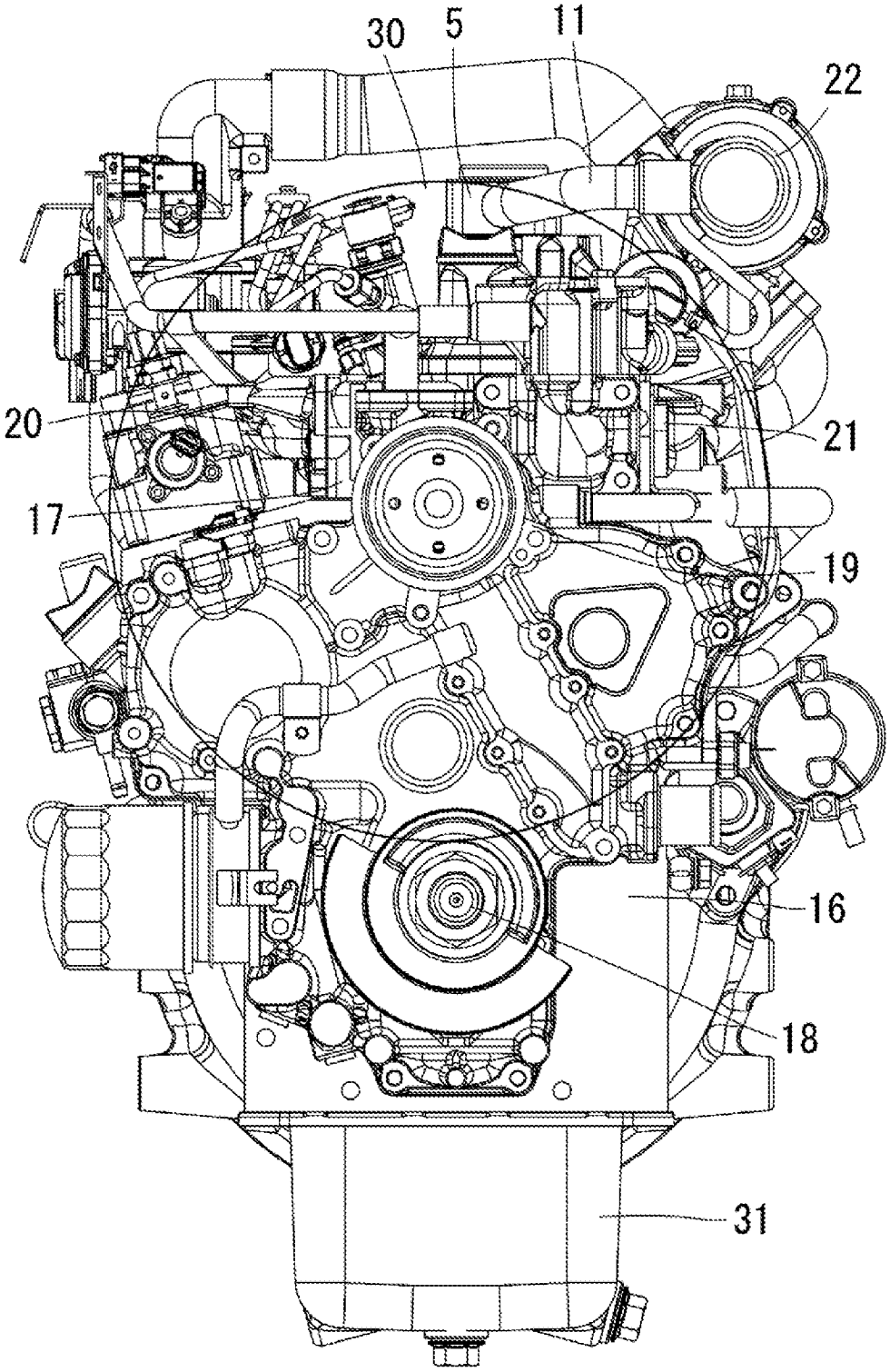
FIG. 3 is a front view of an engine including the breather device of FIG. 1.

FIGS. 1 to 3 are views for explaining a breather device for an engine according to an embodiment of the present invention. In this embodiment, a vertical multi-cylinder diesel engine including the breather device will be described.

The outline of this engine is as follows.

As shown in FIG. 3, this engine includes: a cylinder block (16); a cylinder head (17) attached to an upper part of the cylinder block (16); a cylinder head cover (1) attached to an upper part of the cylinder head (17); an oil pan (31) attached to a lower part of the cylinder block (16); a water pump (19) and an engine cooling fan (30) attached to a front part of the cylinder block (16) with an installation direction of a crankshaft (18) taken as a longitudinal direction; an intake manifold (20) attached to one side in a lateral direction of the cylinder head (17) with a width direction of the engine orthogonal to the longitudinal direction as the lateral direction; an exhaust manifold (21) provided on the other side in the lateral direction of the cylinder head (17); and a supercharger (22) attached to an upper part of the exhaust manifold (21).

The outline of the breather device of this engine is as follows.

As shown in FIG. 1, the breather device includes a valve holder (2) disposed in the cylinder head cover (1), and a breather valve (3) supported by the valve holder (2).

Hence, this embodiment has an advantage that oil can be separated from an oil mist, contained in the blow-by gas (10) flowing out of the cylinder head cover (1), by using the breather valve (3).

As shown in FIG. 1, when viewed in a direction parallel to the installation direction of the crankshaft (18), the valve holder (2) of the breather device is disposed at a position overlapping the rotating engine cooling fan (30) and receiving an engine cooling air blown by the engine cooling fan (30), so that the valve holder (2) is cooled easily.

As shown in FIG. 1, the breather device includes: a breather plate (23) disposed below a ceiling wall (la) of a cylinder head cover (1); a breather chamber (24) formed between the ceiling wall (la) of the cylinder head cover (1) and the breather plate (23); a breather chamber inlet (24*a*) provided at the rear end of the breather chamber (24); a valve holder attachment seat (25) provided on the ceiling wall (la) of the cylinder head cover (1); and a breather chamber outlet (24*b*) provided in the valve holder attachment seat (25), and the valve holder (2) is attached to the valve holder attachment seat (25).

As shown in FIG. 1, the valve holder (2) has a holder inlet (2*a*) communicating with the breather chamber outlet (24*b*), a valve attachment seat (2*b*) for attachment of the breather valve (3), and a valve seat (2*c*) for seating of a valve body (3*a*) of the breather valve (3).

The breather valve (3) is a diaphragm valve.

The breather device includes a valve cover (26) covering the breather valve (3) from above, and a valve spring (27) that is interposed between the valve cover (26) and the breather valve (3) and urges the valve body (3*a*) toward the valve seat (2*c*).

The blow-by gas (10) in the cylinder head cover (1) enters the breather chamber (24) from the breather chamber inlet (24*a*), passes through the breather chamber (24), flows out of the breather chamber outlet (24*b*), and enters the holder inlet (2*a*) of the valve holder (2). When the valve body (3*a*) of the breather valve (3) is opened by the imbalance between the internal pressure of the breather chamber (24) and the internal pressure of a valve port (4) described later, the blow-by gas enters the valve opening (4).

As shown in FIGS. 1 and 2A to 2D, the valve holder (2) includes: a holder body (5) having the valve port (4) of the breather valve (3); the outlet passage pipe (7) formed of metal and having a blow-by gas outlet passage (6) formed inside, the blow-by gas outlet passage (6) communicating with the valve port (4) and being located below the valve port (4); and a heater (8) that heats the outlet passage pipe (7).

The outer peripheral surface of the outlet passage pipe (7) is wrapped with the holder body (5) formed of a material having lower thermal conductivity than that of the outlet passage pipe (7), the holder body (5) has a heater insertion port (9), and the heater (8) is inserted from the heater insertion port (9) toward a heat input wall (7*a*) of the outlet passage pipe (7).

Therefore, in this embodiment, the outlet passage pipe (7) formed of metal is heated by the heater (8) and kept warm by the material for the holder body (5) with low thermal conductivity, and during cold weather, it is possible to prevent the inside of the blow-by gas outlet passage (6) of the valve holder (2) from being blocked due to freezing.

As shown in FIGS. 1, 2A to 2D, the outlet passage pipe (7) includes a pipe start end wall (7*b*) that blocks the pipe start end, a communication port (7*d*) provided in a pipe upper wall (7*c*) near the pipe start end and communicating with the valve port (4), and a pipe terminal peripheral wall (70 having a pipe outlet (7*e*) opened at the opposite end of the pipe start end wall (7*b*), and the pipe start end wall (7*b*) is the heat input wall (7*a*) of the outlet passage pipe (7).

Therefore, in this embodiment, moisture immediately after flowing down from the valve port (4) is promptly warmed by heat input from the heater (8) to the heat input wall (7*a*), and freezing hardly occurs inside of the blow-by gas outlet passage (6).

As shown in FIGS. 1 and 2A to 2D, the outer peripheral surface of the pipe terminal peripheral wall (70 projecting from the outer peripheral surface of the holder body (5) is wrapped with a body projecting portion (5*a*) projecting from the outer peripheral surface of the holder body (5), the outer peripheral surface of the body projecting portion (5*a*) is covered with a tube inlet portion (11*a*) of a discharge tube (11) that discharges blow-by gas (10) from the pipe outlet (7*e*), and both the body projecting portion (5*a*) and the tube inlet portion (11*a*) are made of a material having lower thermal conductivity than that of the outlet passage pipe (7).

Therefore, in this embodiment, the outer peripheral surface of the pipe terminal peripheral wall (70 projecting from the outer peripheral surface of the holder body (5) is covered dually with the body projecting portion (5*a*) and the tube inlet portion (11*a*) having low thermal conductivity, the heat retention property of the pipe terminal peripheral wall (70 is high, and freezing in the pipe terminal peripheral wall (70 is prevented.

The outlet passage pipe (7) is made of aluminum alloy. As the material for the outlet passage pipe (7), another metal may be used, and copper or brass may be used.

The holder body (5) is made of nylon. As the material for the holder body (5), another resin may be used.

The valve holder (2) can be formed by wrapping the outlet passage pipe (7) in the holder body (5) by insert molding.

As shown in FIG. 2D, the holder body (5) has: an outer cylinder (5*b*) including the valve attachment seat (2*b*) on its upper end surface; an inner cylinder (5*d*) including the valve seat (2*c*) and the valve port (4) on its upper end surface, and having a downward hole (5*c*) provided inside, the downward hole (5*c*) connecting the valve port (4) and the communication port (7*d*) located below the valve port (4); a bridge portion (5*e*) installed in the outer cylinder (5*b*) and connecting the inner cylinder (5*d*) and the outer cylinder (5*b*); and a body projecting portion (5*a*) projecting from the outer peripheral surface of the outer cylinder (5*b*) at an outward extended position of the bridge portion (5*e*), as shown in FIG. 2A. The outer peripheral surface of the outlet passage pipe (7) is enclosed by the inner cylinder (5*d*), the bridge portion (5*e*), the outer cylinder (5*b*), and the body projecting portion (5*a*).

As shown in FIG. 2D, the holder inlet (2*a*) and the valve port (4) are communicated with each other via a floating passage (5*f*) provided on both sides of the inner cylinder (5*d*) in the outer cylinder (5*b*), and the blow-by gas (10) at the holder inlet (2*a*) shown in FIG. 1 floats on the floating passage (5*f*) and enters the valve port (4).

As shown in FIG. 1, the breather device includes a power source (12) and a changeover switch (13). The changeover switch (13) includes an OFF position (13*a*) that stops energization from the power source (12), an ON position (13*b*) in which energization from the power source (12) to a predetermined part (15) other than a starter (14) is started before energization from the power source (12) to the starter (14) is started, and a starting position (13*c*) in which the energization from the power source (12) to the starter (14) is started, each as a switching position. The heater (8) is an electric heater (8*a*). Energization from the power source (12) to the electric heater (8*a*) is started at the time of switching the changeover switch (13) from the OFF position (13*a*) to the ON position (13*b*).

Therefore, in this embodiment, before the engine is started by the starter (14), the changeover switch (13) is switched from the OFF position (13*a*) to the ON position (13*b*), and energization from the power source (12) to the electric heater (8*a*) is started, so that freezing in the blow-by gas outlet passage (6) can be eliminated in advance before the start of the engine.

In this embodiment, the predetermined part (15) is an electronic control device (28).

In this embodiment, the electric heater (8*a*) is a positive temperature coefficient (PTC) heater.

Due to a PTC characteristic in which an electric resistance value varies with a positive coefficient as the temperature rises, the PTC heater self-controls a temperature rise without a special control circuit, to enable simplification of the heater energization circuit from the power source (12).

The PTC heater is a heater having a PTC characteristic, and the PTC characteristic means a property that the electric resistance value changes with a positive coefficient as the temperature rises.

In this embodiment, the power source (12) is a battery, the changeover switch (13) is a key switch, and the electronic control device (28) is an engine ECU. ECU is an abbreviation of electronic control device and is a microcomputer.

In this embodiment, when the changeover switch (13) is switched from the OFF position (13*a*) to the ON position (13*b*), energization from the power source (12) to the electronic control device (28) is performed. Thereafter, even when switching is made from the ON position (13*b*) to the start position (13*c*), the energization from the power source (12) to the electronic control device (28) is continued, and energization from the power source (12) to the starter (14) is also performed, whereby the crankshaft (18) is cranked in the starter (14) and the engine is started. Thereafter, when the engine speed reaches a predetermined complete explosion revolution speed, the energization to the starter (14) is canceled. Then, when the changeover switch (13) is returned from the start position (13*c*) to the ON position (13*b*), the energization from the power source (12) to the electronic control device (28) is continued and the engine operation is continued.

In this embodiment, a relay (32) controlled by the electronic control device (28) is provided between the ON position (13*b*) of the changeover switch (13) and the electronic control device (28). When the changeover switch (13) is switched from the ON position (13*b*) to the OFF position (13*a*), the electronic control device (28) having received an OFF switch signal of the changeover switch (13) stops the operation of the engine. Then, after performing internal processing (data storage of the memory etc.), the electronic control device (28) opens the relay (32) to release energization from the power source (12) to the electronic control device (28). Note that reference numeral (29) in FIG. 1 is a diode for blocking energization from the power source to the starter when the changeover switch (13) is switched to the ON position (13*b*).

The electric heater (8*a*) may be an induction heating (IH) heater including an IH coil that induces and heats the metal outlet passage pipe (7).

In this case, the outlet passage pipe (7) serves as a heat source, the heat conduction loss is small, and the heating efficiency of the outlet passage pipe (7) is high.

What is claimed is:

1. A breather device for an engine, comprising:

a valve holder disposed in a cylinder head cover and;

a breather valve supported by the valve holder, wherein the valve holder includes: a holder body having a valve port of the breather valve; an outlet passage pipe formed of metal and having a blow-by gas outlet passage formed inside, the blow-by gas outlet passage communicating with the valve port and being located below the valve port; and a heater that heats the outlet passage pipe, an outer peripheral surface of the outlet passage pipe is wrapped with the holder body formed of a material having lower thermal conductivity than that of the outlet passage pipe, the holder body has a heater insertion port, and the heater is inserted from the heater insertion port toward a heat input wall of the outlet passage pipe.

2. The breather device for the engine according to claim 1, wherein the outlet passage pipe includes: a pipe start end wall closing a pipe start end; a communication port provided in the pipe upper wall near the pipe start end and communicating with the valve port; and a pipe terminal peripheral wall having a pipe outlet opened at the opposite end of the pipe start end wall, and the pipe start end wall is the heat input wall of the outlet passage pipe.

3. The breather device for the engine according to claim 2, wherein an outer peripheral surface of the pipe terminal peripheral wall projecting from an outer peripheral surface of the holder body is wrapped with a body projecting portion projecting from the outer peripheral surface of the holder body, an outer peripheral surface of the body projecting portion is covered with a tube inlet portion of a discharge tube that discharges blow-by gas from the pipe outlet, and both the body projecting portion and the tube inlet portion are made of a material having lower thermal conductivity than that of the outlet passage pipe.

4. The breather device for the engine according to claim 1, comprising:

a power source; and a changeover switch, wherein the changeover switch includes an OFF position that stops energization from the power source, an ON position in which energization from the power source to a predetermined part other than a starter is started before energization from the power source to the starter is started, and a starting position in which the energization from the power source to the starter is started, each as a switching position, the heater is an electric heater, and energization from the power source to the electric heater is started at the time of switching the changeover switch from the OFF position to the ON position.

5. The breather device for the engine according to claim 2, comprising:

a power source; and a changeover switch, wherein the changeover switch includes an OFF position that stops energization from the power source, an ON position in which energization from the power source to a predetermined part other than a starter is started before energization from the power source to the starter is started, and a starting position in which the energization from the power source to the starter is started, each as a switching position, the heater is an electric heater, and energization from the power source to the electric heater is started at the time of switching the changeover switch from the OFF position to the ON position.

6. The breather device for the engine according to claim 3, comprising:

a power source; and a changeover switch, wherein the changeover switch includes an OFF position that stops energization from the power source, an ON position in which energization from the power source to a predetermined part other than a starter is started before energization from the power source to the starter is started, and a starting position in which the energization from the power source to the starter is started, each as a switching position, the heater is an electric heater, and energization from the power source to the electric heater is started at the time of switching the changeover switch from the OFF position to the ON position.

7. The breather device for the engine according to claim 1, wherein the electric heater is a positive temperature coefficient (PTC) heater.

8. The breather device for the engine according to claim 2, wherein the electric heater is a positive temperature coefficient (PTC) heater.

9. The breather device for the engine according to claim 3, wherein the electric heater is a positive temperature coefficient (PTC) heater.

10. The breather device for the engine according to claim 4, wherein the electric heater is a positive temperature coefficient (PTC) heater.

11. The breather device for the engine according to claim 5, wherein the electric heater is a positive temperature coefficient (PTC) heater.

12. The breather device for the engine according to claim 6, wherein the electric heater is a positive temperature coefficient (PTC) heater.

13. The breather device for the engine according to claim 1, wherein the electric heater is an induction heating (IH) heater including an IH coil that induces and heats the metal outlet passage pipe.

14. The breather device for the engine according to claim 2, wherein the electric heater is an induction heating (IH) heater including an IH coil that induces and heats the metal outlet passage pipe.

15. The breather device for the engine according to claim 3, wherein the electric heater is an induction heating (IH) heater including an IH coil that induces and heats the metal outlet passage pipe.

16. The breather device for the engine according to claim 4, wherein the electric heater is an induction heating (IH) heater including an IH coil that induces and heats the metal outlet passage pipe.

17. The breather device for the engine according to claim 5, wherein the electric heater is an induction heating (IH) heater including an IH coil that induces and heats the metal outlet passage pipe.

18. The breather device for the engine according to claim 6, wherein the electric heater is an induction heating (IH) heater including an IH coil that induces and heats the metal outlet passage pipe.

19. The breather device for the engine according to claim 2, wherein the holder body has a downward hole that connects the valve port and the communication port located below the valve port, the communication port is formed downward in series with the downward hole, the blow-by gas outlet passage faces in a front-back direction substantially perpendicular to a direction of the communication port below the communication port, when a back side is defined to be one side in the front-back direction, the heat input wall is disposed at a back end of the blow-by gas outlet passage, and the heater is inserted toward the heat input wall from the back side.

20. The breather device for the engine according to claim 19, wherein an outer peripheral surface of the pipe terminal peripheral wall projecting from an outer peripheral surface of the holder body is wrapped with a body projecting portion projecting from the outer peripheral surface of the holder body, an outer peripheral surface of the body projecting portion is covered with a tube inlet portion of a discharge tube that discharges blow-by gas from the pipe outlet, and both the body projecting portion and the tube inlet portion are made of a material having lower thermal conductivity than that of the outlet passage pipe.

21. The breather device for the engine according to claim 19, comprising:

a power source; and a changeover switch, wherein the changeover switch includes an OFF position that stops energization from the power source, an ON position in which energization from the power source to a predetermined part other than a starter is started before energization from the power source to the starter is started, and a starting position in which the energization from the power source to the starter is started, each as a switching position, the heater is an electric heater, and energization from the power source to the electric heater is started at the time of switching the changeover switch from the OFF position to the ON position.

22. The breather device for the engine according to claim 19, wherein the electric heater is a positive temperature coefficient (PTC) heater.

23. The breather device for the engine according to claim 19, wherein the electric heater is an induction heating (IH) heater including an IH coil that induces and heats the metal outlet passage pipe.

* * * * *